US006802418B2

(12) United States Patent
Atkinson et al.

(10) Patent No.: US 6,802,418 B2
(45) Date of Patent: Oct. 12, 2004

(54) COMPACT PACKAGING FOR GARMENTS MADE FROM DELICATE MATERIALS

(75) Inventors: Leon Atkinson, Asheboro, NC (US); Robert Jansen, Dallas, TX (US); R. Patrick Johnson, Farmingon, UT (US); Ryan E. Park, Herrlman, UT (US); Bruce H. Thompson, Hohokus, NJ (US)

(73) Assignee: Daphne Elmaleh Zohar, Boston, MA (US)

( * ) Notice: Subject to any disclaimer, the term of this patent is extended or adjusted under 35 U.S.C. 154(b) by 96 days.

(21) Appl. No.: 09/826,924

(22) Filed: Apr. 6, 2001

(65) Prior Publication Data

US 2002/0144915 A1 Oct. 10, 2002

(51) Int. Cl.[7] ..... B65D 85/18

(52) U.S. Cl. ..... 206/278; 53/409; 229/87.15

(58) Field of Search ..... 206/278, 292; 53/403, 409, 410, 258, 252, 256, 436; 229/87.15, 87.16, 87.17, 87.19; 220/271, 256.1, 253, 258, 270, 280, 293; 279/87.15, 87.16, 87.17

(56) References Cited

U.S. PATENT DOCUMENTS

| | | | | | |
|---|---|---|---|---|---|
| 2,561,112 | A | | 7/1951 | Hahn | |
| 2,873,830 | A | * | 2/1959 | Wilt | 206/289 |
| 2,936,101 | A | * | 5/1960 | Eimer | 229/145 |
| 2,973,857 | A | * | 3/1961 | Richer | 206/292 |
| 3,193,137 | A | | 7/1965 | McCarthy et al. | |
| 3,209,511 | A | | 10/1965 | Pournier | |
| 3,237,363 | A | | 3/1966 | Spohr | |
| 3,252,567 | A | | 5/1966 | Baron et al. | |
| 3,380,221 | A | * | 4/1968 | Thiele | 53/399 |
| 3,514,019 | A | | 5/1970 | Glaze, Jr. et al. | |
| 3,704,565 | A | | 12/1972 | Glaze, Jr. | |
| 3,826,359 | A | * | 7/1974 | Brecher | 206/216 |
| 3,902,300 | A | | 9/1975 | Glaze, Jr. | |
| 3,908,822 | A | * | 9/1975 | Giberstein | 206/278 |
| 4,802,577 | A | * | 2/1989 | O'Leary | 206/278 |
| 4,863,018 | A | | 9/1989 | King et al. | |
| 4,881,358 | A | | 11/1989 | Berg | |
| 4,922,685 | A | | 5/1990 | Hodges | |
| 4,940,158 | A | * | 7/1990 | Farrell et al. | 220/258.2 |
| 4,972,650 | A | | 11/1990 | Egea et al. | |
| 4,981,229 | A | * | 1/1991 | Lanham | 215/232 |
| 5,007,231 | A | * | 4/1991 | Ingemann | 220/257.2 |
| 5,009,310 | A | * | 4/1991 | Finney | 206/229 |
| 5,042,227 | A | | 8/1991 | Merry | |
| 5,139,163 | A | * | 8/1992 | Diaz | 206/509 |
| 5,230,202 | A | | 7/1993 | Propach et al. | |
| 5,692,606 | A | | 12/1997 | Elmaleh | |
| 5,813,538 | A | | 9/1998 | Kaufman | |
| 6,006,945 | A | * | 12/1999 | Kirkland | 221/1 |
| 6,085,930 | A | * | 7/2000 | Curtis | 206/508 |
| 6,135,253 | A | * | 10/2000 | Weissman et al. | 190/36 |
| 6,192,655 | B1 | | 2/2001 | Todd et al. | |

* cited by examiner

*Primary Examiner*—Lien Ngo
(74) *Attorney, Agent, or Firm*—Diederiks & Whitelaw, PLC

(57) ABSTRACT

A compact package for a garment made from a delicate material includes a container body having a volume of less than 10 in$^3$ (164 cm$^3$), a delicate material garment, a cover member and a cap. The cover member is inserted into the container body atop the garment, followed by the cap. Preferably, a buffer material is arranged between the garment and the cover member within the container body to protect the garment from damage during the packing process. The package is preferably produced by directing the garment and buffer material into a pre-loading tube, followed by shifting of a plunger member to load the container body with the garment, buffer material and the cover member. Subsequently, the cap is snap-fit upon the container body.

27 Claims, 7 Drawing Sheets

COMPACT PACKAGING FOR GARMENTS MADE FROM DELICATE MATERIALS

BACKGROUND OF THE INVENTION

1. Field of the Invention

The present invention pertains to the art of packaging and, more specifically, to a compact packaging arrangement for garments made from delicate materials, particularly hosiery items.

2. Discussion of the Prior Art

There is a wide range of delicate garments sold in the marketplace today. Such garments encompass various items which collectively can be classified as hosiery, including stockings, leggings, knee-highs, panties, pantyhose, many undergarments and the like. A common characteristic of these types of garments is the delicate nature of the materials from which they are made, e.g., nylon, LYCRA, spandex, silk and the like. Due to the delicate nature of the material, particular care must be taken in packaging these types of garments in order to minimize tears or runs.

In the past, these types of delicate garments have been either sold in rather bulky packages or simply without separate packaging in order to minimize the possibility of damaging the items. However, bulky packaging is not considered to be economically advantageous. For instance, higher amounts of packaging materials are needed to form bulky packages as compared to compact packages. In addition, transportation and storage costs are inherently higher in connection with larger packaging. Furthermore, valuable store space can be wasted in displaying a product in bulky packaging as compared to a compact packaging arrangement. Providing products without packaging has applicability to sales in certain merchandise stores, but is not suitable for many other applications.

A significant improvement in the art of packaging delicate garments is considered to be presented in U.S. Pat. No. 5,692,606. The invention covered by the '606 patent recognized the desire to present hosiery in an extremely compact package that can be manufactured, stored, shipped and displayed, as well as carried by consumers in a pocket or handbag, in a convenient and economical manner. Particularly advantageous in connection with the hosiery package disclosed in this patent is not only the compact nature of the package, but also the ability of the hosiery to readily assume an uncompressed state as soon as the package is opened. In this manner, the product can be carried by the user, while also being easily and conveniently useable.

Although significant improvements in the compact packaging of delicate garments have been made in the recent past, there still exists a need in the art for improvements relating to providing both additional assurance against damaging the garments during packaging and enhanced packaging systems. In addition, although various specific packaging arrangements have been proposed in the art, there still exists a need for an improved package which represents an economical and reliable package which can provide for enhanced consumer appeal and provide additional safeguards against potential product damage.

SUMMARY OF THE INVENTION

The present invention is directed to a compact packaging arrangement for delicate garments, wherein the packaging is designed to safeguard against damaging the delicate materials of the garments during packaging thereof. In accordance with the invention, each garment package includes a container body within which a garment is received, and a cover insert arranged within an upper portion of the container body. Preferably, the cover insert includes a cover member provided with a plurality of openings designed to permit air to pass through the cover member as the cover member is placed within the container body. In addition, the cover member is also preferably provided with a pull tab element, preferably a pivotable ring element, for use in connection with removing the cover member to access the garment. In one preferred embodiment of the invention, a buffer material is positioned atop the garment within the container body, between the garment and the cover member, to safeguard the garment from potential damage by the insertion of the cover member.

The package also includes a cap adapted to extend over the container body so as to seal the container body. In accordance with a most preferred form of the invention, upper interior wall portions of the container body are formed with projections beneath which the cover member is placed, thereby retaining the cover member in a position which maintains the garment in place until the cover member is manually removed. Similar projections are also provided on inner wall portions of the cap which cooperate with a lip provided about an open end of the container body in order to secure the cap atop the container body.

A machine and corresponding method for packaging the delicate garments are also provided. In accordance with these aspects of the invention, a fluid source, such as a pneumatic source, is utilized to generate a pressure differential in a delivery or pre-load tube in order to initially draw and then direct the garment, preferably followed by the buffer material, to a pre-positioned container body. Thereafter, the fluid source is used to shift a piston which forces the garment and buffer material into the container body, while also placing the cover member in a position of garment retention. Subsequently, the cap can be suitably positioned to complete the main package. In accordance with one preferred embodiment of the invention, a sealing arrangement is employed to further retain the cap on the container body. The sealing arrangement can include an upper extension having an aperture for hanging the package from a store display rod.

The machine for performing the packaging includes the fluid source, as well as a multi-positioning system designed to systematically arrange the container body for receipt of the garment and buffer material and, subsequently, the cover member. In a semi-automatic form of the machine, provisions are made to assure the safe operation of the machine by either requiring specific placement of the hands of a user during specific phases of operation, or by preventing operation of the machine when the user's hands are sensed in the actual work zones.

Additional objects, features and advantages of the present invention will become more fully apparent from the following detailed description of the invention when taken in conjunction with the drawings wherein like reference numerals refer to corresponding parts in the several views.

DETAILED DESCRIPTION OF THE PREFERRED EMBODIMENTS

Figure 1:
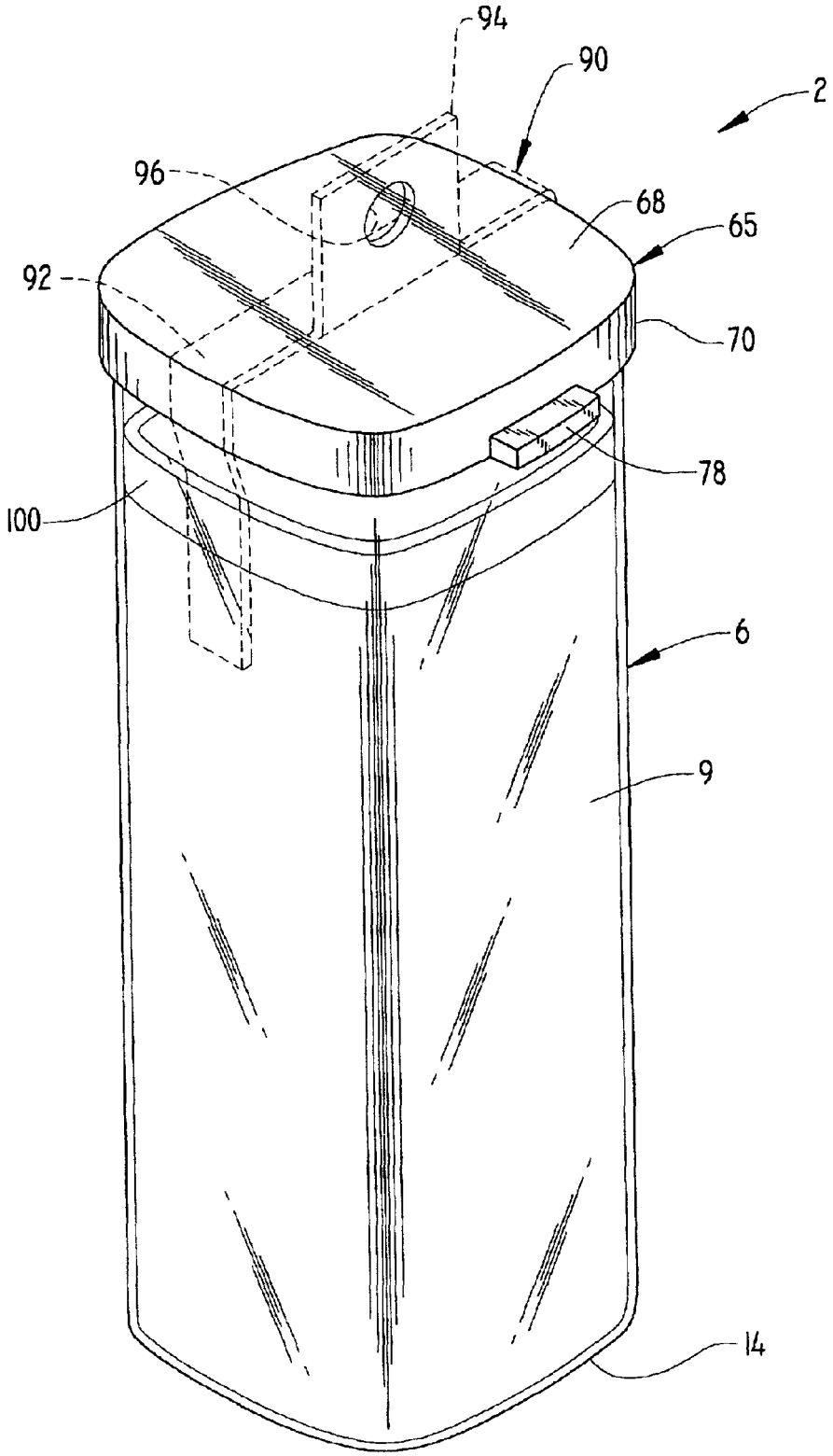
FIG. 1 is an upper perspective view of a compact package for a delicate garment constructed in accordance with the present invention.
Figure 2:
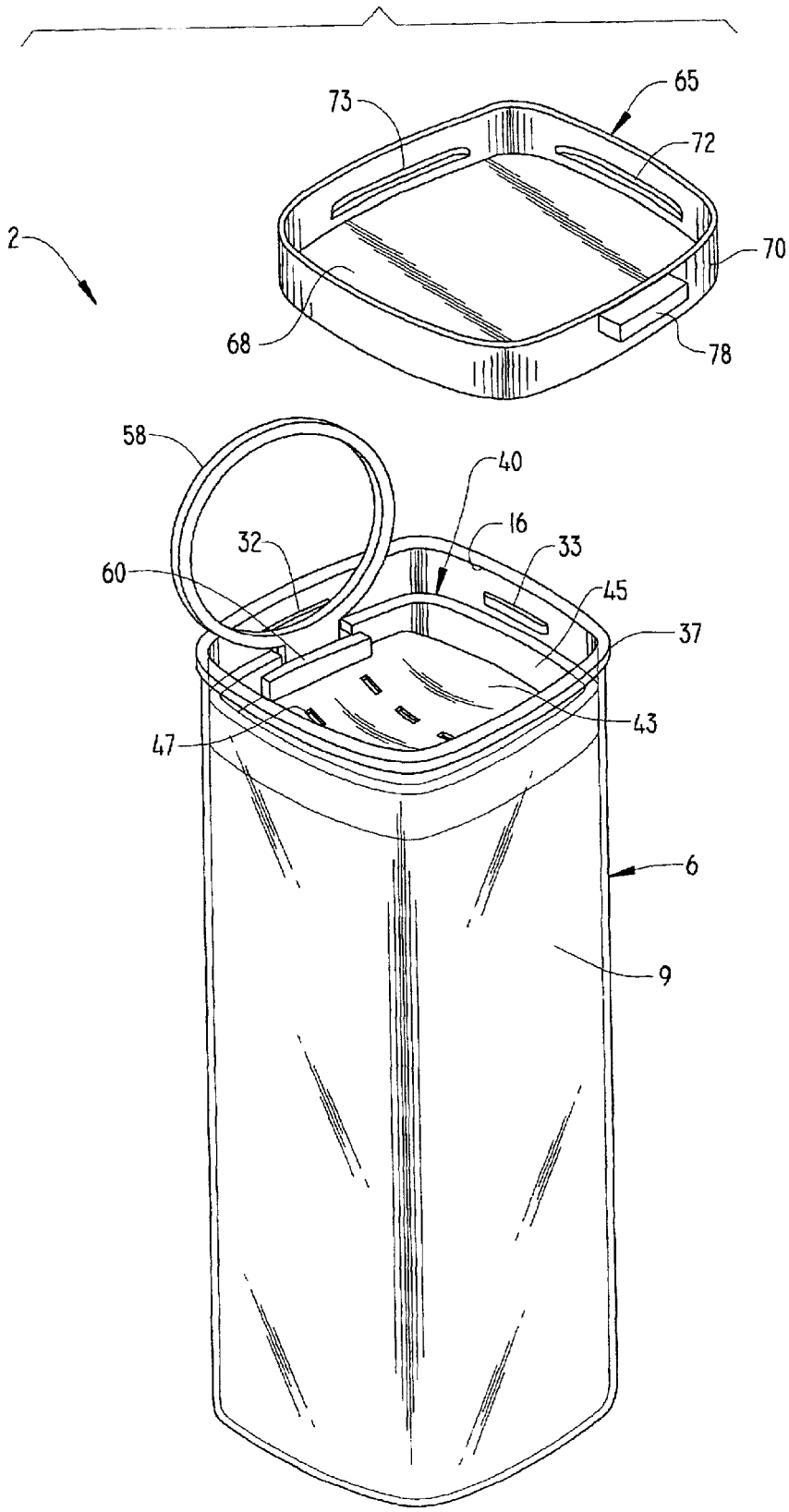
FIG. 2 is a partial exploded view of the compact package of FIG. 1.
Figure 3:
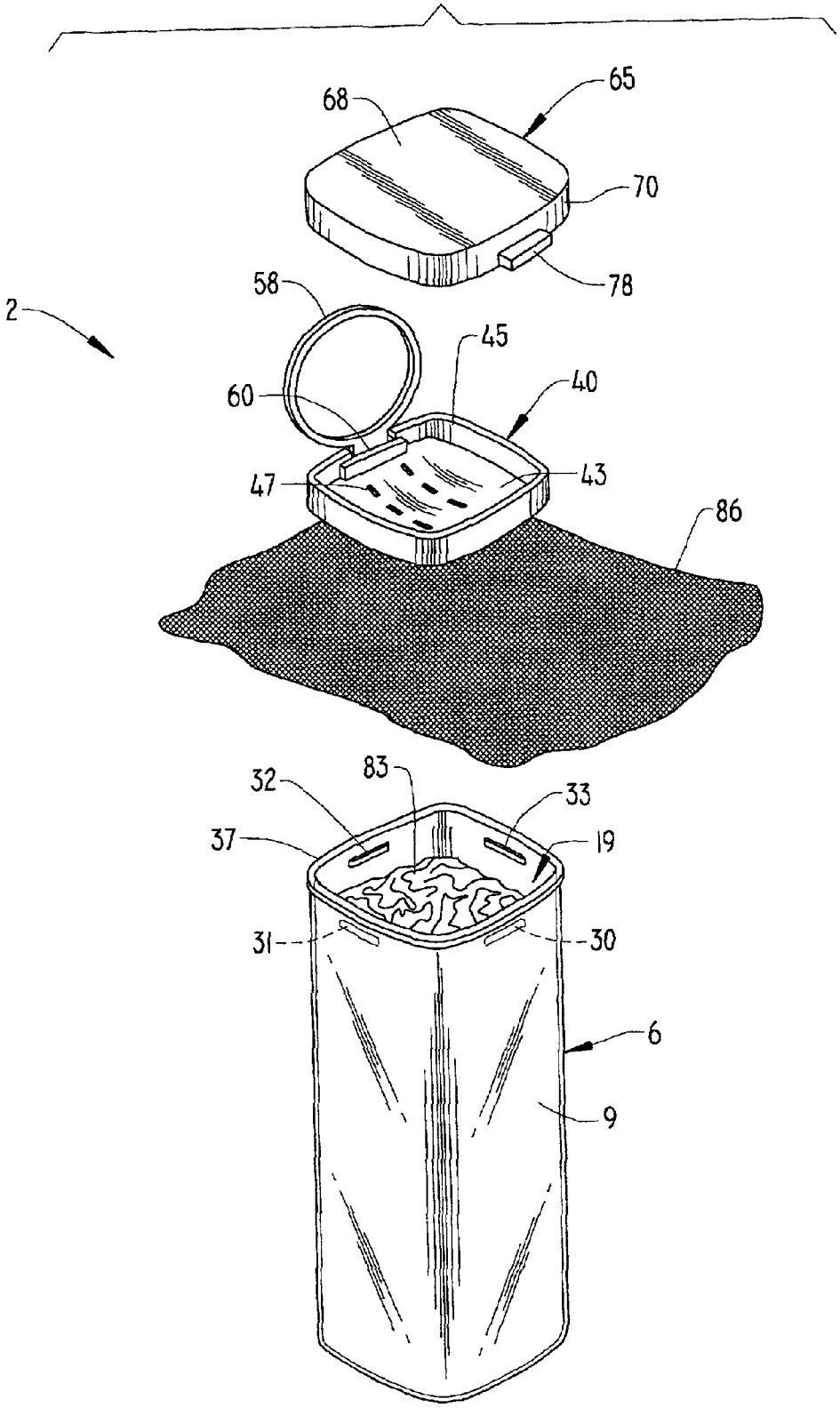
FIG. 3 is a further exploded view of the compact package of FIG. 1.
Figure 4:
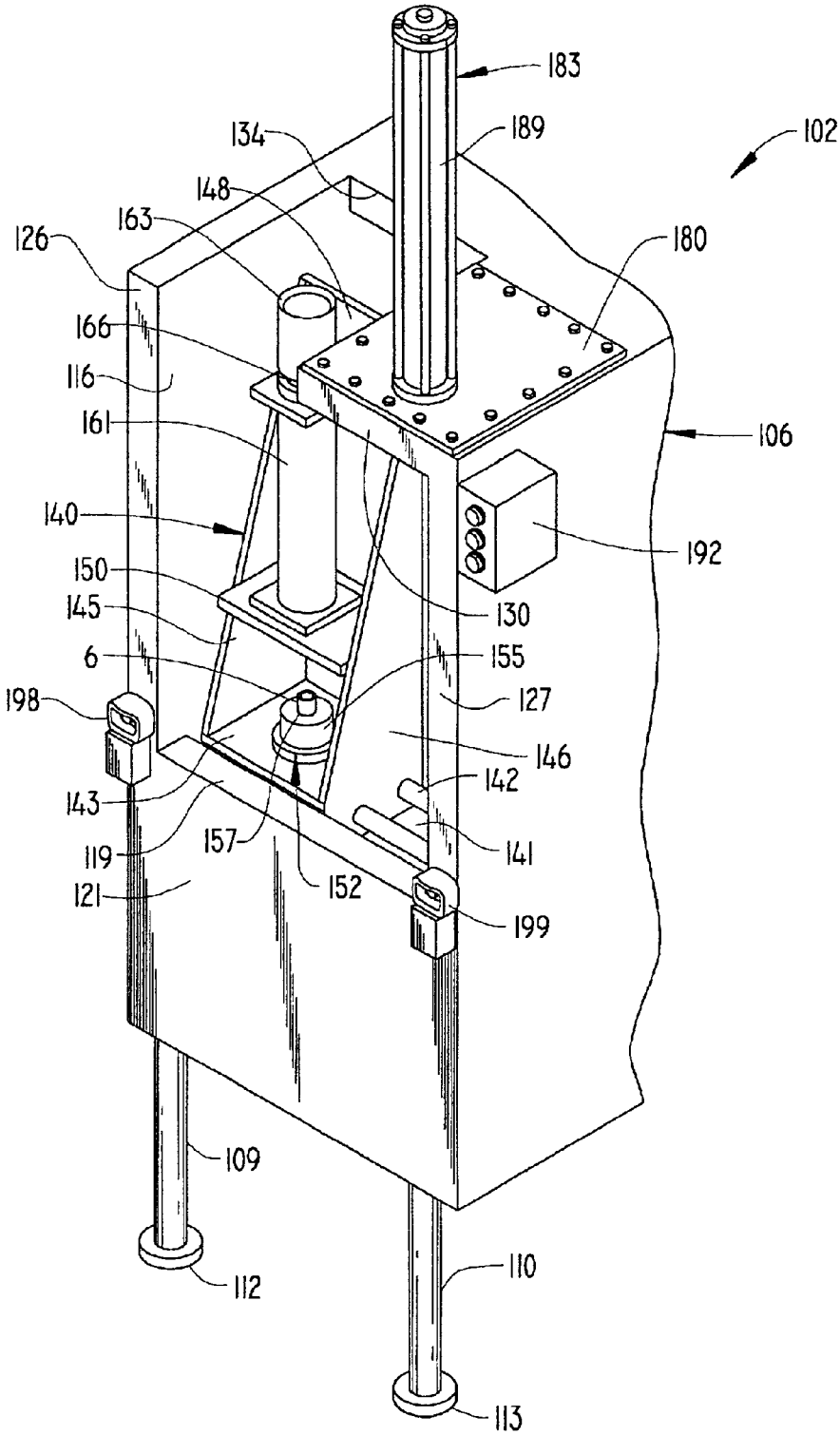
FIG. 4 is an upper right perspective view of a packaging machine, constructed in accordance with a preferred embodiment of the invention, shown in both initial and final packaging stages.
Figure 5:
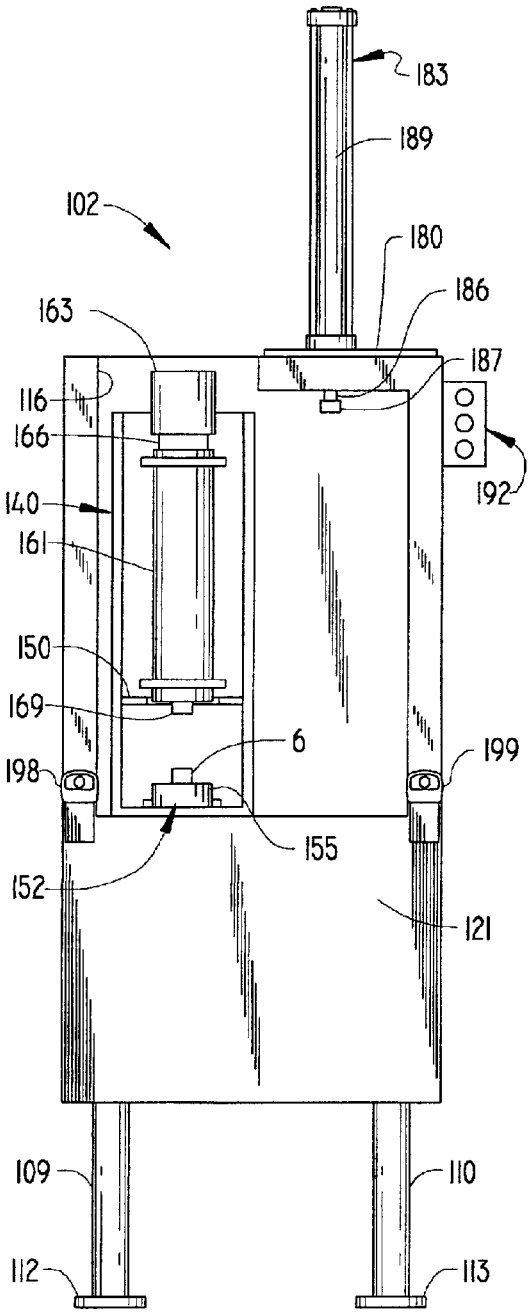
FIG. 5 is a front plan view of the packaging machine in the stages of FIG. 4.
Figure 7:
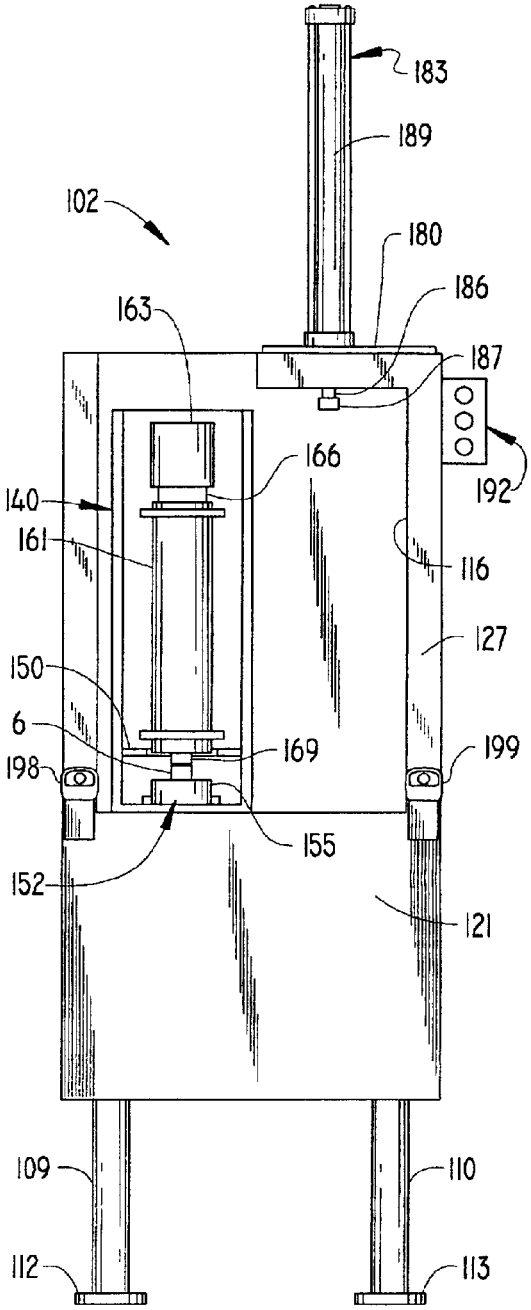
FIG. 7 is a front plan view of the packaging machine of the stage of FIG. 6.
Figure 6:
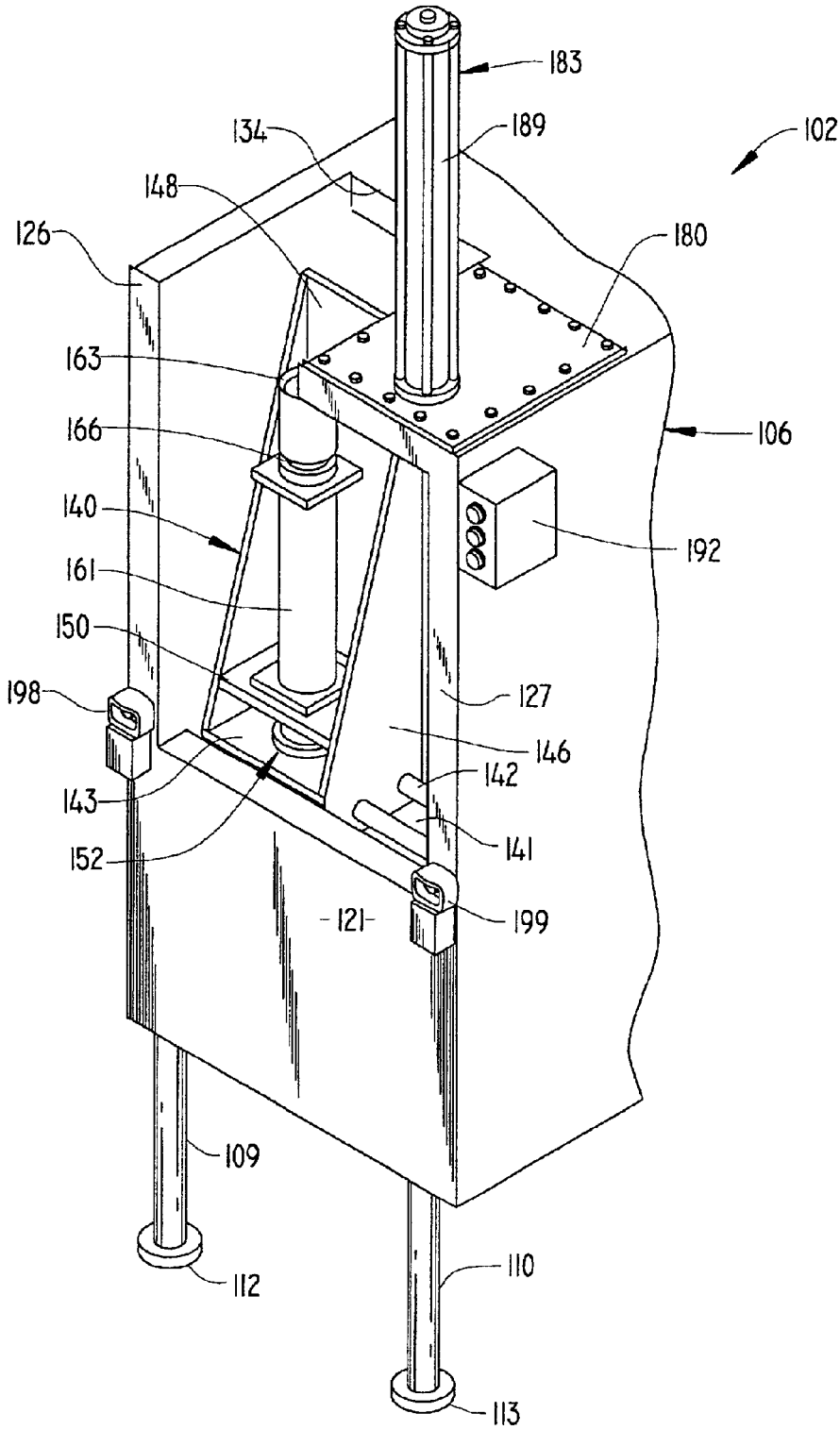
FIG. 6 is an upper right perspective view of the packaging machine of FIG. 4 in a subsequent packaging stage.
Figure 8:
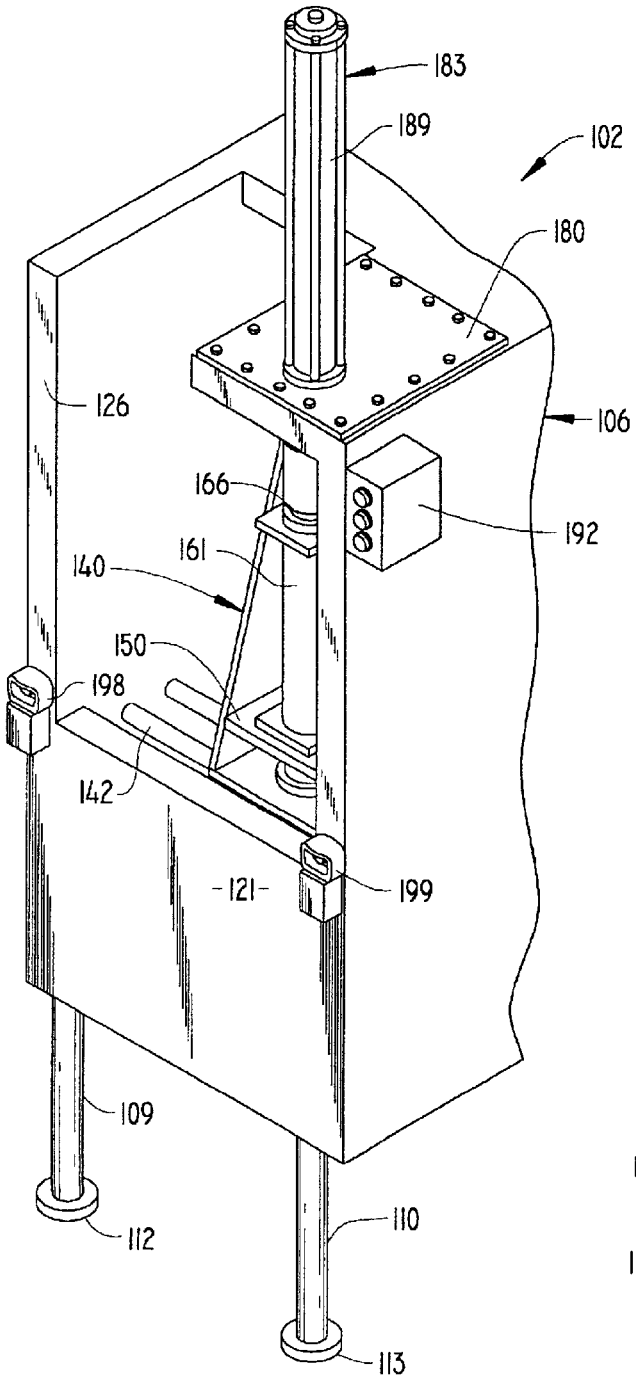
FIG. 8 is an upper right perspective view of the packaging machine of FIG. 5 in a still further packaging stage.
Figure 9:
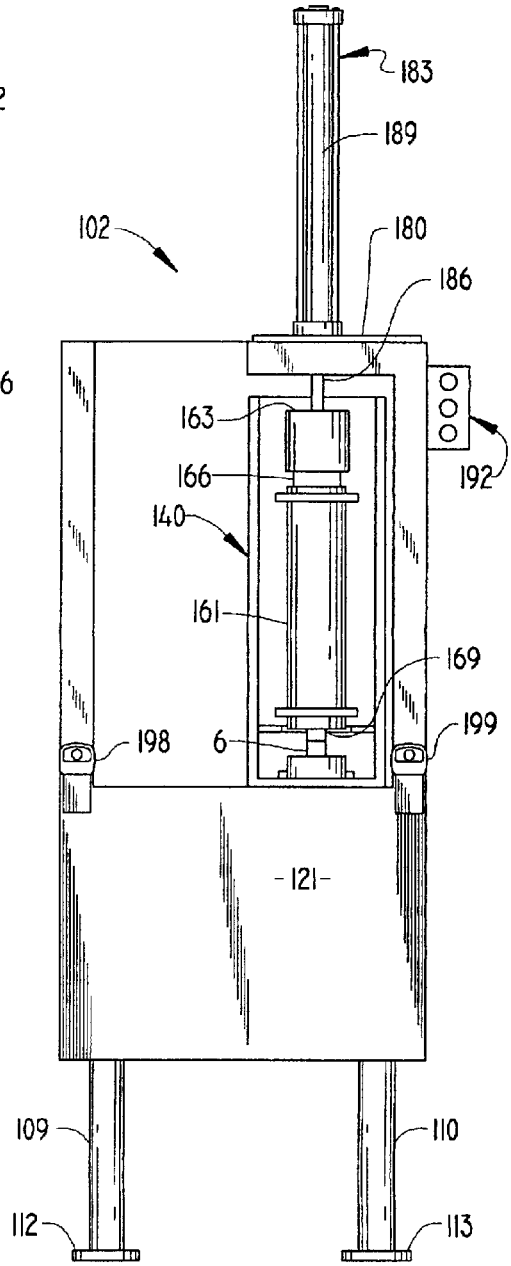
FIG. 9 is a front plan view of the packaging machine in the stage of FIG. 8.

With initial reference to FIGS. 1–3, a compact package, designed for garments made from delicate materials, is generally indicated at 2. Package 2 includes a container body 6, which is preferably molded, such as through an injection molding or blow molding process, of plastic so us to include a plurality of upstanding walls, one of which is indicated 9, a closed bottom 14 and an open upper end 16. With this construction, open upper end 16 leads to an interior stomp chamber 19 defined within container body 6. As clearly shown in FIGS. 2 and 3, the upper inside surface portion (not separately labeled) of storage chamber 19 is farmed with a plurality of inwardly extending projections 30–33. In the most preferred for the invention, container body 6 is transparent. As also shown in these Figures, container body 6 is preferably provided with an annular, outwardly projecting lip 37 at open upper end 16.

Package 2 also includes a cover member 40 which is defined is defined by a base 43 end an upstanding annular sidewall 45. As shown, base 43 is provided with a plurality of openings 47. In the most preferred embodiment, base 43 is curved so as to include a concave upper side and a convex lower side. Cover member 40 also includes a pull-tab 58 that preferably takes the form of a ring. Pull-tab 58 is preferably connected to a portion of annular sidewall 45 through a living hinge generally indicated 60. Therefore, pull-tab 58 can pivot from the position shown in FIGS. 2 and 3 to a position wherein pull-tab 58 is arranged below an upper edge (not separately labeled) of annular sidewall 45. In the most preferred embodiment, cover member 40 is preferably injection molded of plastic.

Package 2 also includes a cap member 65 which is also preferably formed of plastic, however, most preferably of an opaque, colored plastic. Cap member 65 includes a smooth top 68 and a depending, annular sidewall 70. As best shown in FIG. 2, extending inwardly at space locations along annular sidewall 70 are projections 72 and 73. In the most preferred embodiment, additional projections are provided along annular sidewall 70 opposite each of projections 72 and 73 as well. Furthermore, cap member 65 is formed with a flange 78 projecting from annular sidewall 70.

The exploded view of FIG. 3 clearly depicts the presence of a garment 83 within storage chamber 19. In accordance with the invention, garment 83 is formed of a delicate material, such as nylon, LYCRA, silk or the like, which can be easily torn or caused to run. In the most preferred form of the invention, garment 83 constitutes a pair of pantyhose. However, a wide range of products which can be generically classified as "hosiery", including stockings, leggings, knee-highs, panties and various other undergarments, even including sheer bras, could be utilized. At this point, it is important to note that the package 2 of the present invention is specifically designed to compensate for the type of material utilized to form garment 83. To this end, in accordance with one preferred form of the invention, package 2 is also provided with a buffer material 86 which is adapted to be arranged upon garment 83 in storage chamber 19 as will be discussed more fully below. The particular manner in which the entire package 2 is assembled will also be detailed fully below.

Package 2 can also include a seal and hanger assembly 90 (see FIG. 1) including a plastic strip 92 which is preferably, adhesively secured to opposing upstanding walls 9 and along top 68 of cap member 65. As shown, plastic strip 92 is integrally formed with an upstanding hanger member 94 having an aperture 96 for use in connection with hanging package 2 from a conventional display hook or rod in a merchandising store. Also shown on package 2 is a band 100 that extends around terminal end portions (not separately labeled) of plastic strip 92. Band 100 can actually be constituted by a thin strap or can be defined by an elongated label extending down container body 6.

As indicated above, package 2 is specifically designed to store a garment 83 in a compact manner. In general, storage chamber 19 preferably has a total volume of less than 10 $in^3$ (164 $cm^3$). In accordance with the most preferred embodiment of the invention wherein garment 83 constitutes a pair of pantyhose, container body 6 is generally square in cross-section, with each of upstanding walls 9 having a cross-sectional side dimension of approximately 1.25 inches (3.175 cm) and a height of approximately 4 inches (10.16 cm). Therefore, container body 6 has an associated volume of approximately 6.25 $in^3$ (102.4 cubic $cm^3$). In any event, storage chamber 19 is rather small and must maintain garment 83 therein in a compact manner. More specifically, in order to present garment 83 within container body 6, it is necessary to compress garment 83 within storage chamber 19 to multiple times a loose, uncompressed form of garment 83. To this end, the compact package 2 of the present invention is intended to represent an improvement in the particular packaging for storing hosiery in the manner disclosed in U.S. Pat. No. 5,692,606 which is incorporated herein by reference.

Therefore, the packaging in accordance with the present invention is accomplished by compressing garment 83 into storage chamber 19, with garment 83 being compressed to multiple times the loose, uncompressed form thereof. Cover member 40 is adapted to be inserted into storage chamber 19 of container body 6 to retain garment 83 in place. However, due to the delicate nature of the material of garment 83, the present invention preferably incorporates buffer material 86 which is formed separate from garment 83 and is arranged upon garment 83 within storage chamber 19. In accordance with the invention, buffer material 86 is formed from either a light paper material or fabric, even the delicate fabric from which garment 83 is itself formed. In any event, since cover member 40 is inserted into storage chamber 19, there would be the possibility of pinching or otherwise damaging garment 83. However, with buffer material 86 arranged atop garment 83, cover member 40 can be safely inserted within storage chamber 19. During insertion, annular sidewall 45 of cover member 43 abuts projections 30–33 and base 43 will further bow or distort in order to enable cover member 40 to reach the position shown in FIG. 2. Thereafter, cap member 65 can be placed upon container body 6. Of course, pull-tab 58 will be maintained in a lowered position below cap member 65. Due to the interaction between at least projections 72 and 73 of cap member 65 and annular lip 37 of container body 6, cap member 65 will be snap-fitted upon container body 6. Thereafter, if package 2 is to be hung from a conventional display hook, seal and hanger assembly 90 can be attached as described above.

Reference will now be made to FIGS. 4–9 in describing a semi-automated machine 102 utilized in assembling package 2. As shown, machine 102 includes a housing 106 supported by various pedestal legs 109, 110 which terminate in respective support feet 112, 113. As shown, housing 106 includes a frontal opening 116 defined by a front ledge 119 of a front wall 121 of housing 106, respective sidewalls 126 and 127 and a top segment 130. Adjacent top segment 130, along sidewall 126, is a vertically open section 134.

Provided within housing 106 is a platform 140 which is supported upon a floor 141 for lateral shiftable movement along rails 142. Platform 140 includes a base 143, a pair of opposed, angled side plates 145 and 146, and a rear plate 148. Between angled side plates 145 and 146 is arranged a shiftable, intermediate support plate 150. Upon base 143 is fixedly secured a container holder 152 which includes a cylindrical support 155 provided with a central bore 157. Intermediate support plate 150 supports a pre-load tube 161 having an upper opening 163, a venturi zone 166 and a terminal discharge nozzle 169.

Mounted above top segment 130 is a plate 180 which supports a plunger device 183. Plunger device 183 includes a plunger piston rod 186 having an exposed, terminal head 187. Plunger piston rod 186 is adapted to extend from and retract within a cylinder 189 of plunger device 183 as will be discussed more fully below. Also shown in these Figures, machine 102 includes a main power controller 192 having various buttons (not separately labeled) for on, off and pause operational states of machine 102. Finally, machine 102 is shown to include a pair of finger housings 198 and 199 which, as will be detailed below, are provided to initiate a packaging sequence for machine 102 while functioning to assure a safe positioning of the hands of an operator during use of machine 102.

In preparing package 2 with semi-automatic machine 102, container body 6 is initially placed in a non-rotatable position within central bore 157 of holder 152. Furthermore, cover member 40 is positioned within a lower opening (not shown) formed in terminal head 187 of plunger piston rod 186. In accordance with the most preferred form of the invention, machine 102 is preferably, pneumatically operated. For simplicity, the pressurized air source and the respective pneumatic lines have not been shown in the drawings, along with the requisite electrical connections. However, from the following detailed description, the overall operation will be readily apparent to one of ordinary skill in the art. As will be detailed below, pneumatic pressure is utilized in loading garment 83 and buffer material 86 within storage chamber 19, laterally shifting platform 140 along rails 142, and both extending and retracting plunger piston rod 186. In accordance with a preferred embodiment, the pneumatic source supplies approximately 90–100 psi, while developing a force of approximately 200 psi for plunger device 183. In any event, other power sources and force ranges could be readily employed, particularly dependent upon the percentage to which garment 83 is to be compressed within container body 6.

In accordance with the present invention, once container body 6 and cover member 40 are positioned within support 155 and terminal head 187 as discussed above (FIGS. 4 and 5), the operator must engage electrical buttons (not labeled) provided in housings 198 and 199 in order to initiate and maintain an operating cycle for machine 102. Once the operation cycle is initiated, support plate 150 is lowered to the position shown in FIGS. 6 and 7 wherein discharge nozzle extends about upper end 16 of container body 6. Most preferably, the lowermost inner end of discharge nozzle 169 is internally grooved to a thickness corresponding to a thickness of each of sidewalls 9. In this position, garment 83 is dropped into upper opening 163 of pre-load tube 161. Utilizing a pneumatic supply at venturi zone 166, a suction effect is developed between upper opening 163 and venturi zone 166, while air is blown from venturi zone 166 toward discharge nozzle 169. In this manner, garment 83 is readily drawn into pre-load tube 161 and forced down towards discharge nozzle 169. Therefore, when garment 83 is dropped into upper opening 163, garment 83 will be forced down to discharge nozzle 169 and even a portion of garment 83 can extend into container body 6. Thereafter, buffer material 86 is optionally, but preferably, dropped into upper opening 163 such that buffer material 86 is arranged atop garment 83 within pre-load tube 161. Although not specifically shown in the drawings, it should be understood that pre-load tube 161 is internally tapered such that garment 83 and buffer material 86 are pre-loaded into a portion of tube 161 which essentially has internal dimensions substantially equal to that of storage chamber 19.

Once this initial sequence pre-load is accomplished, an operator must again insert one or more fingers in respective finger housings 198 and 199. Again, though not individually shown, buttons or other switching devices are provided within finger housings 198 and 199 which have to be engaged by the user to initiate the automatic operating sequence for machine 102. Once the fingers of the user are properly positioned within finger housings 198 and 199, machine 102 will next proceed on shifting platform 140 laterally until pre-load tube 161 is arranged directly beneath plunger device 183 as clearly shown in FIGS. 8 and 9. Thereafter, plunger piston rod 186 will be automatically extended within pre-load tube 161 thereby causing garment 83 and buffer material 86 to be compressed into storage chamber 19, while also inserting cover member 40 within container body 16.

In this preferred embodiment, buffer material 86 protects garment 83 from any direct engagement with cover member 40, thereby preventing damage to garment 83. During this step, garment 83 and buffer material 86 are each compressed to multiple times their associated loose densities and are retained in this compressed state due to the positioning of cover member 40. During this compression, openings 47 in cover member 40 advantageously permits the exhausting of air being displaced from storage chamber 19. Once cover member 40 is properly positioned, plunger piston rod 186 is automatically retracted, platform 140 is again laterally shifted, and intermediate support plate 150, with pre-load tube 161, is raised back to the position shown in FIGS. 4 and 5. At this point, one complete cycle of machine 102 is complete. The operator's fingers can then be removed from housings 198 and 199 such that container body 6 can be removed from central bore 157 of support is 155. During a subsequent assembly phase, cap member 65 and, if desired, seal and hanger assembly 90, are applied to complete package 2.

With the above construction, package 2 can advantageously maintain a pair of pantyhose or another delicate garment in a compressed state within container body 6, while enabling garment 83 to be easily removed upon flipping off cap member 65, pivoting and lifting pull-tab 58 in order to remove cover member 40, and then withdrawing buffer material 86. Thereafter, garment 83 can be readily pulled from storage chamber 19 for immediate use. In any event, although described with respect to preferred embodiments of the invention, it should be readily understood that various changes and/or modifications can be made to the invention without department from the spirit thereof. For instance, it should be readily apparent that, although machine 102 is constructed for semi-automatic operation, a fully automated system could be employed. In addition, although housings 198 and 199, along with their associated buttons or switches, are shown to be provided for operator controlling and safety purposes. Various other systems could be equally employed. For instance, a foot actuator pedal controller, in combination with a safety light curtain provided at frontal opening 116, could be utilized. Regardless, the invention is only intended to be limited by the scope of the following claims.

We claim:

1. A compact package for a garment made from a delicate material comprising:

a container body defining a storage chamber having an open end;

a garment made from a delicate material having an associated uncompressed, loose form, said garment being compressed within the storage chamber of said container body to multiple times the loose, uncompressed form, wherein the garment constitutes hosiery;

a buffer material, separate from the garment, arranged upon the garment within the storage chamber;

a cover member extending across the open end of the storage chamber to retain the garment and buffer material within the container body; and a plurality of projections provided on an upper inside surface portion of the container body, said cover member engaging the plurality of projections within the storage chamber.

2. The compact package according to claim 1, wherein the cover member includes a body portion provided with a plurality of openings.

3. The compact package according to claim 2, wherein the body portion of the cover member includes an arcuate base.

4. The compact package according to claim 3, wherein a lower side of the base is convex in shape.

5. The compact package according to claim 1, further comprising: a pull-tab element, attached to the body portion of the cover member, for use in removing the cover member from the storage chamber.

6. The compact package according to claim 5, wherein the pull-tab element is pivotally connected to the body portion.

7. The compact package according to claim 6, wherein the pull-tab element constitutes a ring.

8. The compact package according to claim 1, further comprising: a cap member mounted over the open end of the container body.

9. A compact package for a garment made from a delicate material comprising:

a container body defining a storage chamber having an open end, wherein the container body is formed, about at least a portion of the open end, with an outwardly project lip;

a garment made from a delicate material having an associated uncompressed, loose form, said garment being compressed within the storage chamber of said container body to multiple times the loose, uncompressed form, wherein the garment constitutes hosiery;

a buffer material, separate from the garment, arranged upon the garment within the storage chamber;

a cover member extending across the open end of the storage chamber to retain the garment and buffer material within the container body; and a cap member mounted over the open end of the container body, said cap member being formed with a plurality of inner projections, wherein said cap member is snap-fit to the container body with the plurality of inner projections extending about the lip.

10. The compact package according to claim 9, further comprising: a plurality of projections provided on an upper inside surface portion of the container body, said cover member engaging the plurality of projections within the storage chamber.

11. The compact package according to claim 1, wherein the storage chamber has a total volume of less than 10 $in^3$ (164 $cm^3$).

12. The compact package according to claim 1, wherein the buffer material is different from the delicate material of the garment.

13. The compact package according to claim 12, wherein the buffer material is constituted by paper.

14. The compact package according to claim 11, wherein the hosiery constitutes a pair of pantyhose.

15. A compact package for a garment made from a delicate material comprising:

a container body defining a storage chamber having an open end, said storage chamber having a total volume of less than 10 $in^3$ (164 $cm^3$);

a garment made from a delicate material having an associated uncompressed, loose form, said garment being compressed within the storage chamber of said container body to multiple times the loose, uncompressed form, wherein the garment constitutes hosiery;

a cover member, separate from the container body, extending across the open end of the storage chamber to retain the garment within the container body; and a cap member, separate from the container body, mounted to the open end of the container body over the cover member.

16. The compact package according to claim 15, wherein the container body is formed, about at least a portion of the open end, with an outwardly projecting lip, and said cap member is formed with a plurality of inner projections, wherein said cap member is snap-fit to the container body with the plurality of inner projections extending about the lip.

17. A compact package for a garment made from a delicate material comprising:

a container body defining a storage chamber having an open end, said storage chamber having a total volume of less than 10 $in^3$ (164 $cm^3$);

a garment made from a delicate material having an associated uncompressed, loose form, said garment being compressed within the storage chamber of said container body to multiple times the loose, uncompressed form, wherein the garment constitutes hosiery;

a cover member extending across the open end of the storage chamber to retain the garment within the container body, wherein the cover member includes a body portion provided with a plurality of openings; and a cap member mounted to the open end of the container body over the cover member.

18. The compact package according to claim 17, wherein the body portion of the cover member includes an arcuate base.

19. The compact package according to claim 18, wherein a lower side of the base is convex in shape.

20. The compact package according to claim 15, further comprising: a pull-tab element, attached to the body portion of the cover member, for use in removing the cover member from the storage chamber.

21. The compact package according to claim 20, wherein the pull-tab element is pivotally connected to the body portion.

22. The compact package according to claim 21, wherein the pull-tab element constitutes a ring.

23. The compact package according to claim 15, further comprising: a plurality of projections provided on an upper inside surface portion of the container body, said cover member engaging the plurality of projections within the storage chamber.

24. The compact package according to claim 15, further comprising: a buffer material arranged upon the garment within the storage chamber.

25. The compact package according to claim 24, wherein the buffer material is different from the delicate material of the garment.

26. The compact package according to claim 25, wherein the buffer material is constituted by paper.

27. The compact package according to claim 15, wherein the hosiery constitutes a pair of pantyhose.

* * * * *